United States Patent [19]

Eisenblätter

[11] Patent Number: 4,718,204

[45] Date of Patent: Jan. 12, 1988

[54] LAMELLAR END GRINDING WHEEL

[76] Inventor: Gerd Eisenblätter, Jägerweg 10, 8192 Geretsried 2, Fed. Rep. of Germany

[21] Appl. No.: 861,270

[22] Filed: May 9, 1986

[30] Foreign Application Priority Data

Jul. 18, 1985 [DE] Fed. Rep. of Germany ..... 3525620
Nov. 22, 1985 [DE] Fed. Rep. of Germany ..... 3541348

[51] Int. Cl.[4] ..... B24D 13/16
[52] U.S. Cl. ..... 51/337; 51/364
[58] Field of Search ..... 51/330, 331, 332, 334, 51/336, 337, 358, 364, 376, 388; 15/230.16, 230.17, 230.19

[56] References Cited

U.S. PATENT DOCUMENTS

| | | | |
|---|---|---|---|
| 1,445,295 | 2/1923 | Cangen | 51/364 |
| 1,869,564 | 8/1932 | Johnston | 15/230.18 |
| 2,079,995 | 5/1937 | Hodgkins | 29/78 |
| 2,423,992 | 7/1947 | Nordgren et al. | 51/190 |
| 3,616,581 | 11/1971 | Johnson et al. | 51/337 |
| 4,133,146 | 1/1979 | De Cola | 51/336 |

FOREIGN PATENT DOCUMENTS

| | | | |
|---|---|---|---|
| 2359483 | 6/1975 | Fed. Rep. of Germany | 51/358 |
| 1370846 | 10/1974 | United Kingdom | 51/334 |

*Primary Examiner*—Robert P. Olszewski
*Attorney, Agent, or Firm*—Fleit, Jacobson, Cohn & Price

[57] ABSTRACT

The invention relates to a lamellar end grinding wheel in which abrasive flaps engage over one another in tile-like manner along the circumferential zones of a circular disc-shaped back plate and are advantageously fixed with the aid of fingers. The abrasive flaps are also anchored in the back plate in that thickened portions are provided along one or both sides of the rear edge region thereof. The anchoring means can also comprise the abrasive flaps having one or more slot-like recesses in the edge region thereof and through these can be passed fingers or finger portions.

21 Claims, 15 Drawing Figures

LAMELLAR END GRINDING WHEEL

BACKGROUND OF THE INVENTION

The invention relates to a lamellar or fan-type end grinding wheel in which abrasive or grinding flaps overlapping one another in tile-like manner and which are fixed are located along the circumferential zone of a circular disc-shaped, flexible base or back plate and project through radial slots in the circumferential zone.

Lamellar end grinding wheels can be used in numerous different ways, but are preferably employed in angle grinders. However, such lamellar end grinding wheels can also be used in drilling machines or similar grinding equipment.

A preferred field of use for lamellar end grinding wheels is the smoothing and cleaning of welding seams and spots. In this connection, such lamellar end grinding wheels can also be used for roughing and polishing, without it being necessary to use different wheels or grain sizes. Thus, with the aid of a single tool, it is possible to obtain a particularly good surface quality. However, lamellar end grinding wheels of the present type are also suitable for other operations such as deburring, bevelling, rust removal or removing old paint. It is possible to work the most varied materials such as steel, refined steel, nonferrous metals, aluminium, rigid plastics, artificial stone, rocks, wood or fillers.

In the known lamellar end grinding wheels, the back plate is made from a synthetic material or plastic. However, in the past, the latter has been replaced by vulcanized fibre - pressboard as the back plate material. The abrasive flaps are inserted in the back plate either in recesses provided for this purpose and bonded with synthetic resin, or the abrasive flaps are bonded onto the plastic material of the back plate. It must be ensured that on applying the abrasive flaps to the plastic material of the back plate, said flaps are brought into the arrangement necessary for the abrasive or grinding action, in which the flaps overlap one another in tile-like or flake-like manner.

Although good working results are achieved with the known lamellar end grinding wheels, disadvantages have also been revealed in practice. For example it has been found that in the case of corresponding loading, the plastic back plates can break apart. It has also hitherto been impossible to exclude, even in the case of careful processing, that individual abrasive flaps will be ejected from their fixture during the abrasion or grinding process.

The necessary elasticity of the plastic back plate is generally obtained only as a result of the incorporation of a certain amount of moisture. It was therefore necessary, after the manufacture of the plastic back plate to store it for several weeks under enviromental conditions, so as to permit the necessary moisture absorption. However, due to differing climatic conditions, the storage process was very difficult to calculate, so that wheels were obtained with a not sufficiently defined elasticity. It could also arise that, as a result of the stresses occurring at high speeds or higher working loads, a plastic back plate was broken, which led to a considerable risk of injury.

Difficulties also arose in bonding the synthetic resin used for bonding the abrasive flaps in the plastic back plate. It was found that during operation and with corresponding working loading, there can be such a significant degree of heating that the adhesive became soft, so that individual flaps or groups thereof could be ejected, which also led to a certain risk of injury.

A lamellar end grinding wheel of the aforementioned type is known from U.S. Pat. No. 3,616,581.

SUMMARY OF THE INVENTION

The problem of the present invention is to provide a back plate for a lamellar end grinding wheel ensuring in the case of simple manufacture a sufficiently high operational reliability.

According to the invention this problem is solved in that the back plate is constructed as a sheet metal disc and the abrasive flaps are secured by the edges of the radial slots by clamping.

The present invention leads to the important advantage and advance in the art that for a low weight, such a high strength of the grinding wheel arrangement can be achieved, that even under extremely high speeds the operational reliability is extraordinarily high. Thus, the invention ensures that the back plate has such a high strength and stability, that the previously existing risk of breaking apart is completely removed. The invention also ensures such a reliable fixing of the abrasive flaps in the back plate, that it is substantially impossible, even at high speeds, to eject an abrasive flap from its mounting support during operation.

The back plate according to the invention is also able to withstand considerable loads during operation without damage and this more particularly applies with respect to squeezing loads.

Working with the back plate according to the invention is also advantageous because it has a relatively low weight, despite its very high strength and stability. A further important advantage results from the fact that substantially all breakage risks and consequently any risk of injury is reliably avoided.

According to an advantageous embodiment of the invention, the clamping action is in each case provided by at least one finger or tongue and that the latter is shaped onto the edge or a radial slot.

According to a preferred further development of the invention, the fingers are subdivided into several finger portions.

It can also be advantageous to fit the finger in reciprocally displaced manner on two facing edges of the slots.

According to an advantageous further development of the invention, the fingers have stamping points projecting counter to the opening or display direction. This further increases the reliability with which the abrasive flaps can be fixed in the back plate.

The stamping points can be realized in a particularly simple manner in that they are constructed as angular and acute-angled edges or rims. If after the insertion of the abrasive flaps, the tongues are forced by a corresponding tool into the principal plane of the back plate, an extremely firm and durable anchoring of the flaps to the plate is ensured.

According to a particularly preferred further development of the invention, a supporting disc is arranged on the side of the back plate remote from the working surface, the circumferential edges of the back plate and supporting disc are firmly interconnected and between the back plate and supporting disc the rear ends of the abrasive flaps are firmly secured. This leads to a back plate arrangement, which not only has an extremely high dimensional stability and squeezing stability, but also offers the possibility of simply and reliably anchoring the abrasive flaps in the back plate, by pressing the latter and the supporting disc against one another, following the interconnection thereof in the circumferential region.

Alternatively, the problem of the invention is solved in that each abrasive flap is provided at its rear end with an anchoring means.

This measure is based on the idea that the naturally flat abrasive flaps should be designed in such a way that they support the clamping action through their shape. This solution consequently has the advantage that a wheel arrangement is obtained, which not only has an extremely high dimensional stability and squeezing stability, but also provides the possibility of the manufacturer being able to simply and reliably fix the abrasive flaps. This solution also has all the advantages referred to hereinbefore in connection with the other inventive solution.

An advantageous further development of this inventive solution comprises constructing the anchoring means as a thickened portion on the rear end of the abrasive flap. This has the advantage that in the case of tension effects, the thickened portion is supported on the slot edges or against the end face of a finger or is inserted between the back plate and a finger and is wedged there.

Another advantageous construction of the anchoring means is provided in that there is at least one recess in the rear edge region of the abrasive flap, through which can be passed a finger or at least a finger portion. This anchoring means has the advantage that the abrasive flap is hooked in in relatively large-area form.

It can also be advantageous for the anchoring means to have two laterally open recesses, in which engage the end faces of the particular back plate slot.

If the associated finger is also subdivided into several finger portions, it is possible to achieve both a supporting of the abrasive flap between the back plate and the finger portions and a hanging of the abrasive flap in one of the finger portions.

In place of fingers for engagement in the recesses of the abrasive flaps, it can also be advantageous for a flat, arcuate strip to be passed through the recesses of several juxtaposed abrasive flaps.

The abrasive flaps are advantageously fixed in that they are bonded to the back plate.

BRIEF DESCRIPTION OF THE DRAWINGS

The invention is described in greater detail hereinafter relative to non-limitative embodiments and the attached drawings, wherein show.

DESCRIPTION OF THE PREFERRED EMBODIMENTS

Figure 1:
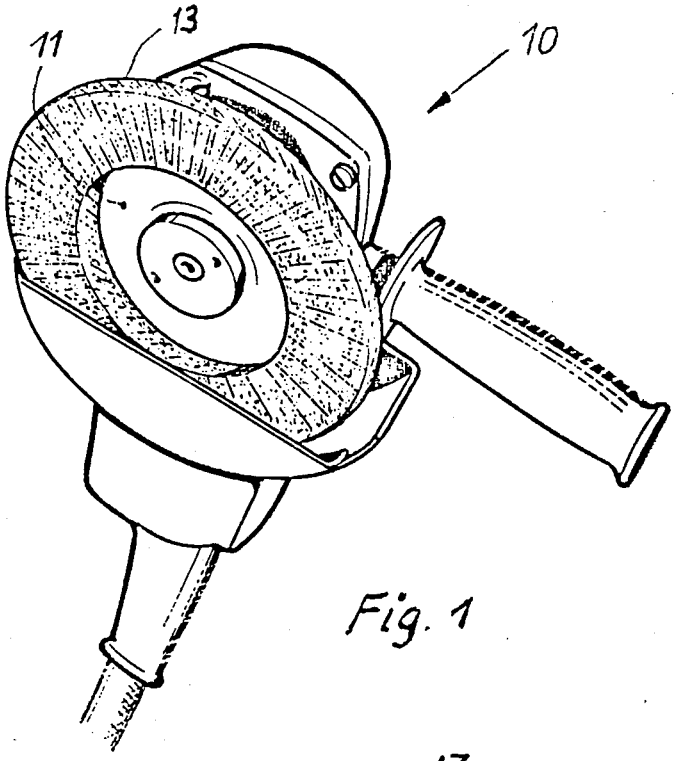
FIG. 1 A perspective view of an angle grinder with a lamellar end grinding wheel according to the invention.

FIG. 1 perspectively shows an angle grinder 10 equipped with a lamellar end grinding wheel. The latter is constructed in such a way that abrasive or grinding flaps, superimposed in tile-like or flake-like manner are fitted to a back or base plate 11 made from metal and preferably from an aluminium alloy and for which five embodiments are described hereinafter. The abrasive flaps 13 are fixed to the back plate 11 in the manner described hereinafter.

Figure 2:
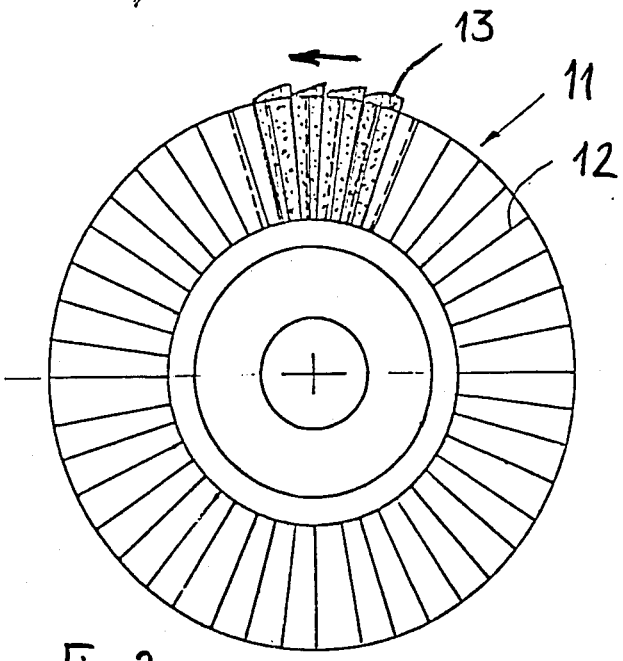
FIG. 2 A diagrammatic view of a back plate whereof several variants are described in the following drawings and which is partly equipped with abrasive flaps.

Firstly radial slots 12 are made in the outer circumferential area of the basically circular disc-shaped back plate 11, in the manner diagrammatically illustrated in FIG. 2. In the areas adjacent to the radial slots 12, fingers are then pressed on in gill-like or Venetian blind-like manner. This leads to sloping through-openings, into which are inserted the rear ends of the abrasive flaps 13. Thus, as early as this manufacturing phase, the flaps 13 have the preferred direction, which is necessary for subsequent operation. After passing the abrasive flaps 13 through radial slots 12, the fingers are pressed together again from the rear side of back plate 11, so that the abrasive flaps 13 are firmly anchored in said plate 11.

For reinforcing purposes the back plate 11 can be provided with a reinforcing seam 3, which has a favourable influence on the dimensional stability of back plate 11, particularly under high operating loading, i.e. squeezing.

Figure 3:
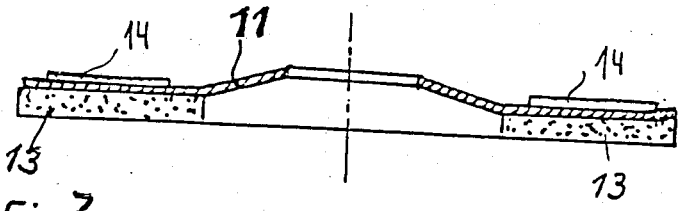
FIG. 3 A section through the back plate shown in FIG. 2 (first embodiment).

In a section through the back plate according to FIG. 2, FIG. 3 illustrates the abrasive flaps 13 in their position completely fixed on plate 11. According to FIG. 3, the back plate 11 is provided on its side remote from the working surface with fingers 14, which are in each case fitted to the edge of slots 12. FIG. 3 shows the fingers 14 in the state in which they are pressed firmly on to the back plate 11, the rear part of the abrasive flaps pass through slot 12 being in this way fixed.

Thus, the lamellar end grinding wheel is produced in that in each case one abrasive flap is inserted with its rear end through a slot 12 and then the latter is clamped to back plate 11 by bending over and pressing together the associated finger 14.

Figure 4:
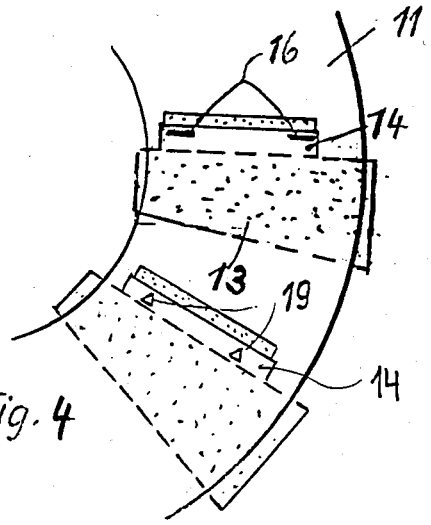
FIG. 4 A diagrammatic partial view of the back plate according to FIG. 3 to illustrate the stamping points on the fastening straps of the back plate for the abrasive flaps.

The fixing of the abrasive flaps 13 can be improved in that stamping points 16 are formed on fingers 14, as diagrammatically illustrated in FIG. 4. These stamping points 16 can be small protuberances, which are provided on that side of finger 14 facing the abrasive flaps 13. If the fingers 14 are pressed to for anchoring the abrasive flaps 13, the raised stamping points 16 are embedded in the material of flaps 13 and thus form additional anchoring points.

In place of the stamping points 16 illustrated in FIG. 4, e.g. the edges of the fingers 14 could be slightly bent in the direction of the abrasive flaps 13 and can be constructed in acute-angled manner, so that on pressing the fingers 14, the edge regions are embedded to such an extent in the material of the abrasive flaps 13, that the latter are reliably anchored in the back plate 11.

In the lower part of FIG. 4 is diagrammatically shown an alternative embodiment of the stamping points. Two barbs 19 are formed in finger 14 and their tips are embedded in the material of abrasive flaps 13 on pressing together the back plate 11, the fingers 14 being pressed into the material of the latter.

The barbs 19 are produced in such a way that initially an angular slot is made in a finger 14. The area of the finger 14 enclosed by the angular slot is then bent out of the finger plane counter to the direction in which the tongue is opened with respect to the back plate. An abrasive flap 13 can easily be inserted in the slot, without there being any significant impediment by the barbs bent out towards the flap. Only when the fingers 14 have been firmly pressed on to the abrasive flaps 13 are the barbs 19 embedded in the abrasive flap material and therefore form a highly operationally reliable fixing of the abrasive flaps 13 to back plate 11.

Figure 5:
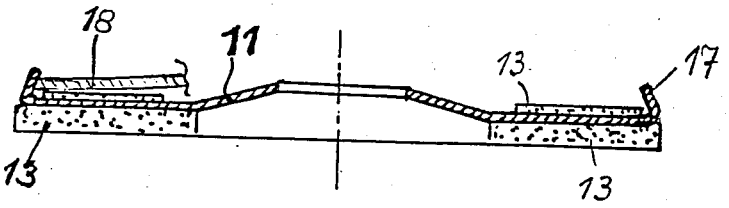
FIG. 5 A section through a back plate (second embodiment).

FIG. 5 illustrates in a section through the back plate according to FIG. 2 a further embodiment. According to FIG. 5 the back plate 11 is provided on its outer circumference with a circumferential flange 17, which is bent over in hook-like manner with respect to the principal plane of plate 11. This circumferential flange can e.g. be beaded over.

According to FIG. 5 the outer circumferential rim of back plate 11 is bent over by more than 90° in order to form the circumferential flange 17. The circumferential flange 17 gives the back plate 11 an extremely high torsional stiffness, which has a favourable influence on the dimensional stability in operation. The slightly inwardly turned over edges of the circumferential flange 17 form a circular opening. As the diameter of the circumferential flange 17 increases conically towards the principal plane of the back plate 11, there is a widening from the circumferential edge of the circumferential flange 17 towards the principal plane of back plate 11 of the space surrounded by flange 17. It is therefore possible to fix behind the circumferential edge of the circumferential flange 17 a ring e.g. made from cardboard or carton. Such a not shown ring can cover the rear flap clamping means and said ring can also serve as a label for the grinding wheel according to the invention.

An alternative embodiment of the object of the invention is diagrammatically indicated in FIG. 5 in that the rear region of back plate 11, i.e. the region remote from the abrasive flaps 13 is covered by a supporting disc 18, which in FIG. 5 is purely diagrammatically illustrated in a partial section in the left-hand region only. The supporting disc can extend over the entire circular disc surface of the back plate 11, naturally with the exception of the always necessary reception bore. If the supporting disc 18 has a design and particularly a strength and rigidity roughly corresponding to the corresponding characteristics of back plate 11, a very stable, rigid construction is obtained. The supporting disc 18 can also be used for bending over and also clamping the rear ends of the abrasive flaps 13.

It is generally sufficient to firmly connect the supporting disc 18 to the back plate 11 in the outer circumferential area, e.g. by welding, bonding or beading. However, it is also possible to provide additional fastening points on the surface of the two plates/discs, if this is desirable to achieve even higher strength, stability and rigidity.

Like the back plate 11, supporting disc 18 can be made from light metal, so that an extremely light, but at the same time elastic and very stable construction is obtained. This construction is also substantially corrosion-resistant and as a spent waste product is also advantageous from the environmental standpoint.

Figure 6:
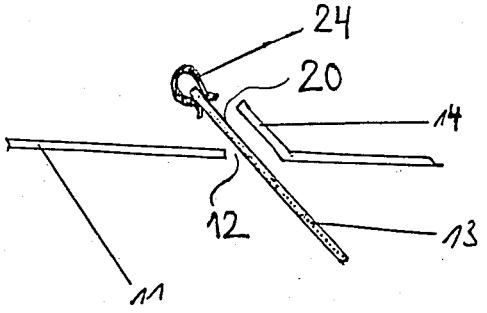
FIG. 6 Diagrammatically a cross-section along the circumferential line of a back plate (third embodiment).

FIG. 6 shows an embodiment of a lamellar end grinding wheel in a purely diagrammatic cross-section along the circumferential line. The abrasive flap 13 is provided in its rear edge region 20 with a thickened portion 24, which can e.g. be a tubular, slotted bracket, which extends essentially over the entire width of flap 13. This bracket can e.g. be fitted to the abrasive flap 13 by bonding or riveting.

Figure 7:
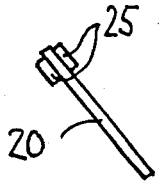
FIGS. 7 to 9 In each diagrammatic details of an abrasive flap.
Figure 8:
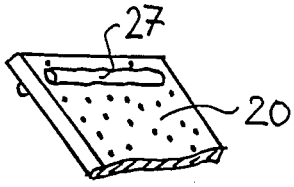
Figure 9:
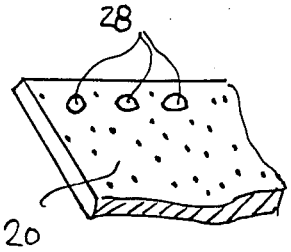

FIG. 6 obviously does not illustrate the final state of the grinding wheel, when the finger 14 is pressed firmly against back plate 11, so that the abrasive flap 13 is clamped. In this state, finger 14 presses on the edge region 20, so that the end face of finger 14 is also embedded in the material of the abrasive flap 13. If tensile forces act on the abrasive flap 13 on the working side of the grinding wheel, then the thickened portion 24 is braced against finger 14. This leads to a reliable anchoring of the abrasive flap 13 and prevents removal from slot 12. FIGS. 7, 8 and 9 show further embodiments for an anchoring means, comprising a thickened portion, on the rear edge region 20 of an abrasive flap.

In FIG. 7, the thickened portion is formed in that essentially along the entire width of the abrasive flap, edge strips 25 are fitted to either side. These edge strips 25 can e.g. be made from strong cardboard, light metal plates or some other tear-resistant material.

In the embodiment of FIG. 8, the thickened portion comprises adhesive beads 27 applied to either side.

FIG. 9 illustrates an embodiment, in which the thickened portion is produced by rivets 28, which are inserted in the abrasive flap at certain points along the edge of the rear edge region 20.

It is inherent in all these anchoring means, that they cooperate in positively engaging manner with the clamping of the abrasive flap and prevent a removal from the back plate.

Figure 10:
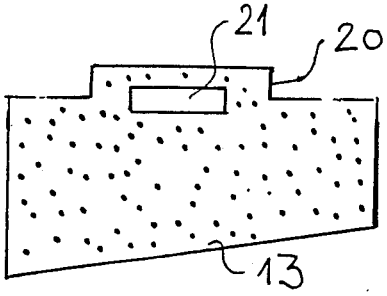
FIGS. 10 to 12 Diagrammatically a view of an abrasive flap.
Figure 11:
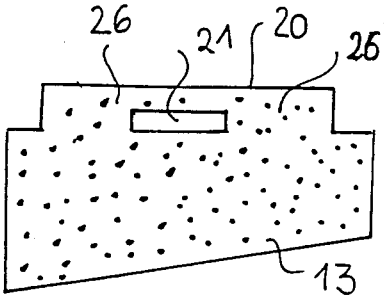
Figure 12:
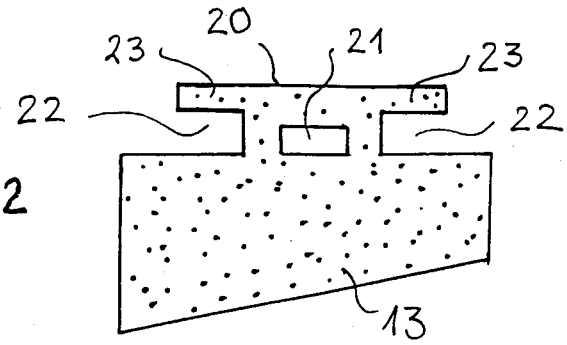
Figure 13:
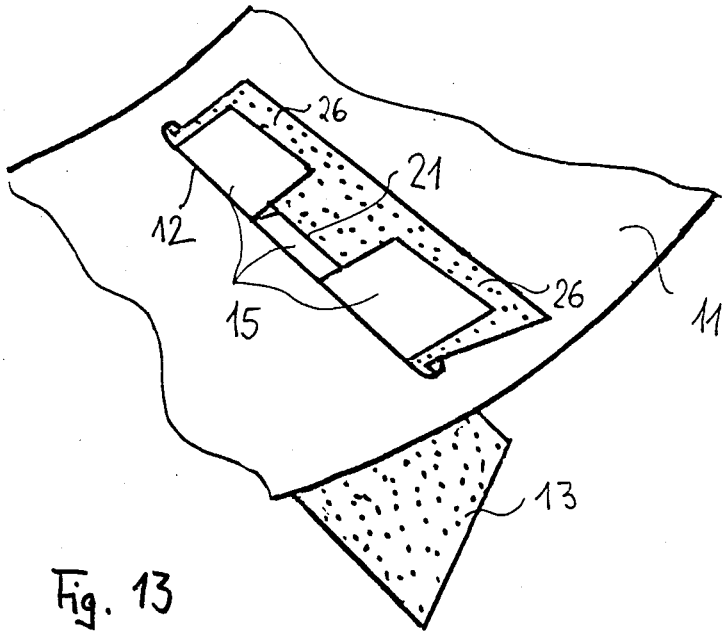
FIG. 13 A diagrammatic partial view of a back plate (fourth embodiment) for illustrating the fingers.

FIGS. 10, 11 and 12 diagrammatically illustrate advantageous further developments of the anchoring means formed in the rear edge regions 20 of the abrasive flaps 13. According to FIG. 10, the anchoring means comprises a slot-like recess 21, through which is passed a finger 14 (FIG. 6) or a corresponding finger portion 15 (FIG. 13). The abrasive flap 13 according to FIG. 11 has lateral clamping zones 26, alongside the recess 21 and their function will be described relative to FIG. 13. If desired, the recesses of several juxtaposed abrasive flaps may have a flat arcuate strip passed therethrough.

FIG. 12 shows in exemplified manner an abrasive flap 13, which has two lateral open recesses 22, in addition to the recess 21, which is completely surrounded by the abrasive flap material, so that projecting abrasive flap arms 23 are formed. The ends of the slots on the back plate engage in recesses 22. The projecting arms 23 extend over the longitudinal extension of a radial slot in the back plate and ensure an additional mounting support through being supported on said plate.

FIG. 13 shows an embodiment of a lamellar end grinding wheel, which is provided along slot 12 with a plurality of finger portions 15. An abrasive flap 13 according to FIG. 11 is passed through slot 12 and the middle finger portion is introduced through its slot-like recess 21. The two outer finger portions are in each case located on a clamping zone 26 of abrasive flap 13 and press the latter against back plate 11. The abrasive flap 13 is consequently secured on the one hand by a clamping effect exerted by the outer finger portions and on the other by anchoring on the central finger portion. For hooking the abrasive flap 13 in the central finger portion, it can be advantageous if its free end is tapered (not shown).

Figure 14:
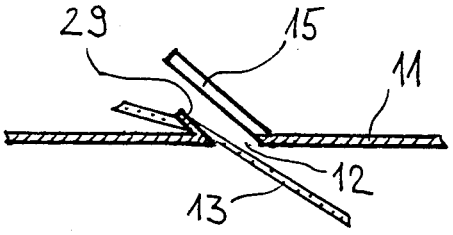
FIG. 14 Diagrammatically a cross-section along the circumferential line through a further back plate (fifth embodiment).
Figure 15:
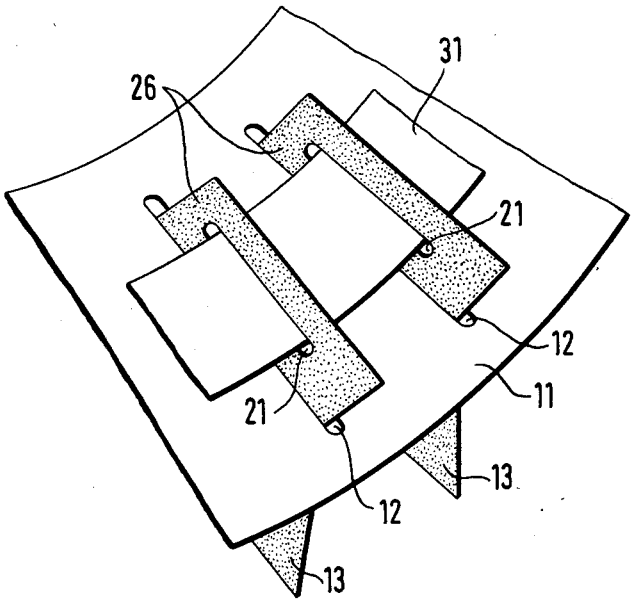
FIG. 15 A diagramatic, partial view of a back plate with abrasive flaps extending therethrough and an arcuate strip extending through openings defined by a rear end of each abrasive flap.

FIG. 14 illustrates another embodiment and constitutes a circumferential section roughly along the axis of back plate 11. Finger portions 15 are provided on one edge of slot 12 and a further finger portion 29 on the other edge thereof. The further finger portion 29 engages in a not shown slot 21 in abrasive flap 13, as described in connection with FIG. 13. The reproduction of this arrangement is purely diagrammatic and does not show the final state in which the finger portions 15, 16 are pressed against back plate 11.

Quite independently of the way in which the abrasive flaps 13 are held by jamming in the radial slots, the further measure can be provided that the rear edge regions 20 of flaps 13 are bonded to the back plate and/or on the fingers 14, or on the finger portions 15.

I claim:

1. Lamellar end grinding wheel, in which abrasive flaps overlap one another in tile-like manner and are fixed along the circumferential zone of a circular disc-shaped flexible back plate and project through radial slots in the circumferential zone, said back plate being a sheet metal plate and said abrasive flaps being held by clamping by edges of the radial slots and each of said slots including at least one finger being shaped onto an edge of said radial slots for said clamping.

2. Lamellar end grinding wheel according to claim 1, wherein the fingers are subdivided into several finger portions.

3. Lamellar end grinding wheel according to claim 1, wherein reciprocally displaced fingers are fitted to two facing edges of said slots.

4. Lamellar end grinding wheel according to claim 1, wherein each finger has projecting stamping points extending towards the base of the abrasive flap.

5. Lamellar end grinding wheel according to claim 4, wherein the stamping points are constructed as angular, acute-angled edges.

6. Lamellar end grinding wheel according to claim 1, wherein on the side of the back plate remote from a working surface is provided a supporting disc, the circumferential edges of the back plate and supporting disc are firmly interconnected and between the back plate and supporting disc are firmly secured the rear ends of the abrasive flaps.

7. Lamellar end grinding wheel according to claim 1, wherein on a rear edge region of each abrasive flap is provided an anchoring means.

8. Lamellar end grinding wheel according to claim 7, wherein the anchoring means on the rear edge region is constructed as a thickened portion of the abrasive flap.

9. Lamellar end grinding wheel according to claim 8, wherein the thickened portion comprises rivets which are inserted in the abrasive flap at a certain point along the edge of the rear edge region.

10. Lamellar end grinding wheel according to claim 8, wherein the thickened portion comprises adhesive beads applied to either side of the abrasive flap.

11. Lamellar end grinding wheel according to claim 8, wherein the thickened portion comprises edge strips fitted to either side of the abrasive flap.

12. Lamellar end grinding wheel according to claim 7, wherein said anchoring means comprises at least one recess arranged in a rear edge region of the abrasive flap and through which can be passed said finger or at least one finger portion.

13. Lamellar end grinding wheel according to claim 7, wherein said anchoring means comprises two laterally open recesses on each abrasive flap for the engagement of ends of each radial slot.

14. Lamellar end grinding wheel according to claim 1, wherein the abrasive flaps are bonded to the back plate.

15. Lamellar end grinding wheel, in which abrasive flaps overlap one another in tile-like manner and are fixed along the circumferential zone of a circular disc-shaped, flexible back plate and project through radial slots in a circumferential zone, a rear end of each abrasive flap includes an anchoring means formed by a completely surrounded recess of each abrasive flap and a flat, arcuate strip passed through said recess of several juxtaposed abrasive flaps.

16. Lamellar end grinding wheel, in which abrasive flaps overlap one another in tile-like manner, project through radial slots in the circumferential zone of a circular disc-shaped flexible back plate and are held by clamping along the circumferential zone characterized in that the clamping effect is formed by in each case at least one finger and that the latter is shaped onto the edge of a radial slot.

17. Lamellar end grinding wheel according to claim 16, wherein the fingers are subdivided into several finger portions.

18. Lamellar end grinding wheel according to claim 16, wherein reciprocally displaced fingers are fitted to two facing edges of slots.

19. Lamellar end grinding wheel according to claim 16, wherein each finger has projecting stamping points extending towards the base of the abrasive flap.

20. Lamellar end grinding wheel according to claim 19, wherein the stamping points are constructed as angular, acute-angled edges.

21. Lamellar end grinding wheel according to claim 16, wherein by clamping each flap by means of at least one finger, the ends of the abrasive flaps comprise a slot-like recess, through which is passed a finger or a corresponding finger portion and that each finger or corresponding finger portion, which passes through a slot-like recess, tapers.

* * * * *